US006480820B1

(12) United States Patent
Clopton et al.

(10) Patent No.: US 6,480,820 B1
(45) Date of Patent: Nov. 12, 2002

(54) METHOD OF PROCESSING AUDITORY DATA

(75) Inventors: Ben M. Clopton, Bainbridge Island, WA (US); Sean Kenneth Ridgway Lineaweaver, Seattle, WA (US); Scott S. Corbett, III, Portland, OR (US); Francis A. Spelman, Seattle, WA (US)

(73) Assignee: Advanced Cochlear Systems, Inc., Snoqualmie, WA (US)

( * ) Notice: Subject to any disclaimer, the term of this patent is extended or adjusted under 35 U.S.C. 154(b) by 0 days.

(21) Appl. No.: 09/399,428

(22) Filed: Sep. 20, 1999

(51) Int. Cl.[7] ..... G10L 21/06
(52) U.S. Cl. ..... 704/203; 607/56
(58) Field of Search ..... 704/200–215, 704/220, 221, 226, 225, 224; 607/55, 56, 57, 137

(56) References Cited

U.S. PATENT DOCUMENTS

| | | | | | |
|---|---|---|---|---|---|
| 2,938,079 | A | * | 5/1960 | Flanagan | 704/209 |
| 3,714,566 | A | * | 1/1973 | Kang | 324/76.15 |
| 4,025,964 | A | | 5/1977 | Owens | |
| 4,267,410 | A | | 5/1981 | Forster et al. | |
| 4,284,856 | A | | 8/1981 | Hochmair et al. | |
| 4,357,497 | A | * | 11/1982 | Hochmair et al. | 128/903 |
| 4,515,158 | A | | 5/1985 | Patrick et al. | |
| 4,918,745 | A | | 4/1990 | Hutchison | |
| 5,040,217 | A | | 8/1991 | Brandenburg et al. | |
| 5,095,904 | A | | 3/1992 | Seligman et al. | |
| 5,214,708 | A | | 5/1993 | McEachern | |
| 5,381,512 | A | | 1/1995 | Holton et al. | |
| 5,434,924 | A | * | 7/1995 | Jampolsky | 381/17 |
| 5,574,639 | A | | 11/1996 | Qian et al. | |
| 5,597,380 | A | * | 1/1997 | McDermott et al. | 607/137 |
| 5,800,475 | A | * | 9/1998 | Jules | 607/57 |
| 5,832,414 | A | | 11/1998 | Hart et al. | |
| 5,991,663 | A | * | 11/1999 | Irlicht et al. | 607/56 |
| 6,235,056 | B1 | * | 5/2001 | Kennedy | 600/25 |
| 6,259,951 | B1 | * | 7/2001 | Kuzma et al. | 600/25 |
| 6,266,568 | B1 | * | 7/2001 | Mann et al. | 607/137 |
| 6,342,035 | B1 | * | 1/2002 | Kroll et al. | 600/25 |

* cited by examiner

*Primary Examiner*—David D. Knepper
*Assistant Examiner*—Abul K. Azad
(74) *Attorney, Agent, or Firm*—Law Office of Timothy E. Siegel; Timothy E. Siegel

(57) ABSTRACT

A method for the real-time transformation of an electrical signal representative of a sound wave that includes the steps of providing an electrical signal representative of a sound wave, transforming that signal to an analytic representation, and passing said electrical signal, in parallel, through a number of bandpass filters to create a set of time domain real and imaginary band limited signals. Next, a stream of instantaneous phase angle and magnitude values for each of said set of time domain real and imaginary band limited signals is computed. Thirdly, a stream of electrical pulses or other digital representation of the phase, instantaneous frequency, and magnitude information is computed for delivery to a cochlear implant or transmission for decoding and synthesis of the original sound.

15 Claims, 6 Drawing Sheets

| Filter Number | Passband (Hz) | | Stopband (Hz) | |
|---|---|---|---|---|
| | Lower Edge | Upper Edge | Lower Edge | Upper Edge |
| 1 | 70 | 250 | 10 | 310 |
| 2 | 170 | 360 | 100 | 460 |
| 3 | 280 | 460 | 200 | 540 |
| 4 | 380 | 590 | 300 | 670 |
| 5 | 460 | 740 | 360 | 860 |
| 6 | 570 | 930 | 400 | 1100 |
| 7 | 720 | 1100 | 520 | 1300 |
| 8 | 888 | 1277 | 688 | 1477 |
| 9 | 1080 | 1500 | 780 | 1800 |
| 10 | 1200 | 1900 | 900 | 2200 |
| 11 | 1460 | 2200 | 1160 | 2500 |
| 12 | 1780 | 2550 | 1480 | 2850 |
| 13 | 2160 | 3020 | 1860 | 3320 |
| 14 | 2627 | 3603 | 2427 | 3803 |
| 15 | 3203 | 4317 | 2903 | 4617 |
| 16 | 3917 | 5204 | 3417 | 5504 |

FIG. 3

METHOD OF PROCESSING AUDITORY DATA

STATEMENT OF GOVERNMENTAL SUPPORT

This invention was made with government support under Grant No.: 1 R43NS37944-01 awarded by the Small Business Innovation Research Program of the Department of Health and Human Services. The Government has certain rights in the invention.

BACKGROUND OF THE INVENTION

The present invention is related to a method of transforming an electrical signal representative of a sound wave as a step in the electrical stimulation of a mammalian cochlea or for the purpose of effecting data compression of the electrical signal.

The human cochlea is a complex biochemical-electrical organ of the inner ear that translates sound waves into electrochemical impulses in the auditory nerve. Physically, the human cochlea is a coil having a wound, sound receiving surface, known as the basilar membrane, of approximately 32 mm in length. Over the past twenty years, research in the fields of bioengineering and psychoacoustics have led to enhanced access to the cochleas of hearing impaired individuals and to a better understanding of the critical elements in sound necessary for restoring hearing through the direct electrical stimulation of the cochlea in the hearing impaired. This knowledge has also led to advancement in the compression of sound representation in digital files.

Sound at a particular frequency impinging on the eardrum causes a traveling wave to exist in the cochlea, at the sound frequency with its maximum at a location corresponding to the frequency Sounds with multiple spectral components stimulate different portions of the cochlea, with higher frequency sounds stimulating cochlear loci near the initial (basal) portions of the basilar membrane and lower frequency sounds stimulating the more inner (apical) portions of the coil. Nerve fibers emanating from the various regions of the cochlea are associated with the frequencies that most efficiently stimulate those regions, and the brain, which receives neural impulses from the distributed fibers, maps those frequencies in accord with this association. The nerve stimulated by this traveling wave is associated, in the brain, with the frequency of the sound both due to this mapping of the locus associated with frequency and due to the timing of nerve impulses which tend to reflect the periodicities of lower frequencies. These time patterns of impulses carry information about single frequencies and about the relative magnitudes and phases of multiple frequency components in sounds. For this reason both the spatial mapping of frequencies and the complex timing relationships of the nerve impulses they evoke contribute to the full perception of sounds including speech.

In addition, the relative timing of auditory events at the two ears provides crucial information to a listener. For example, the difference in the times of arrival for sound vibrations at the two ears provides the listener with information about the direction in which the sound has traveled. Until now, the signal processing mechanisms of cochlear implants did not stimulate the cochlea in conformity with the timing of the arriving sound to the point where, even for those patients who were equipped with binaural implants, patients could determine the direction from which sound was arriving.

In addition to hearing restoration, this patent application addresses some problems encountered in the field of data compression of electrical signals representative of sound waves for the purposes-of efficient storage, transmission, and reproduction. One currently popular form of data compression of sound wave signals is included in the "Motion Picture Experts Group Layer 3 Audio Coding" or more simply "MPEG Layer 3." Advances in the field of psychoacoustics, specifically an understanding that much of a sound signal is unperceived by a human listener because it is masked by other portions of the sound signal or is redundant because sound energies within a restricted range of frequencies are not distinguished by human hearing, permit MPEG Layer 3 to achieve a data compression ratio of slightly better than ten-to-one. Unfortunately, the creation of an MPEG Layer 3 signal is not a real time process. Because of this, it is not suitable for use in telephony or other real time processes.

BRIEF SUMMARY OF THE INVENTION

The first aspect of the present invention is a method for the real-time transformation of an electrical signal representative of a sound wave that includes the steps of providing an electrical signal representative of a sound wave passing said electrical signal, in parallel, through a number of bandpass filters to create a set of time domain real and imaginary band limited signals. Next, a stream of instantaneous phase angle and magnitude values for each of said set of time domain real and imaginary band limited signals is computed. Thirdly, a stream of electrical pulses or other digital representation of the phase and magnitude information is computed for delivery to a cochlear implant or transmission for decoding and synthesis of the original sound.

In a separate aspect the present invention is a method for effecting hearing restoration by the electrical stimulation of a human cochlea, comprising providing a cochlear implant assembly, including a microphone, a signal processing assembly connected to the microphone and a set of electrodes contacting the cochlea and being operatively connected to the signal processing assembly. Also, the microphone receives sound waves and translates them into an electrical signal and the signal processing assembly detects predefined events in the electrical signal in each frequency band out of a set of frequency bands and emits a set of signals in response to each detection of a predefined event. Additionally, at least one of the set of electrodes electrically stimulates the cochlea in response to each set of signals.

In a further separate aspect the present invention is a method for effecting hearing restoration by the electrical stimulation of the cochlea of a human, comprising providing a cochlear implant assembly, including a microphone, a signal processing assembly connected to the microphone, a set of electrodes contacting the cochlea and being operatively connected to the signal processing assembly. Also, the microphone receives sound waves and translates them into an electrical signal and the signal processing assembly iteratively chooses a frequency-magnitude pair in each frequency band out of a predefined set of frequency bands, each frequency-magnitude pair being representative of the sound in the frequency band. Additionally, the electrodes are stimulated in response to the frequency magnitude pairs.

In a yet further separate aspect the present invention is a method for effecting hearing restoration by the electrical stimulation of a human cochlea, comprising providing a cochlear implant assembly, including a microphone a signal processing assembly connected to the microphone and a set of electrodes contacting the cochlea and being operatively connected to the signal processing assembly. The microphone and the signal processing assembly form a set of abstracted frequency-magnitude pairs based on a sound signal received by the microphone A plurality of the electrodes cooperatively simulate the sound of all magnitude-frequency pairs.

In a still further separate aspect the present invention is a method for the real time data compression of an auditory signal, comprising the steps of converting the auditory signal into a digital electronic signal having an initial sampling rate, in real time and forming a time sequence of abstracted parameter values, representative of the auditory signal, in real time. Additionally, the time sequence is encoded to form an encoded time sequence that includes a full representation of the abstracted parameter values less often than the initial sampling rate of the auditory signal.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

FIG. 3 is a table showing the division of a portion of the auditory spectrum into frequency bands according to a preferred embodiment of the present invention.

DETAILED DESCRIPTION OF THE PREFERRED EMBODIMENTS

Figure 1:
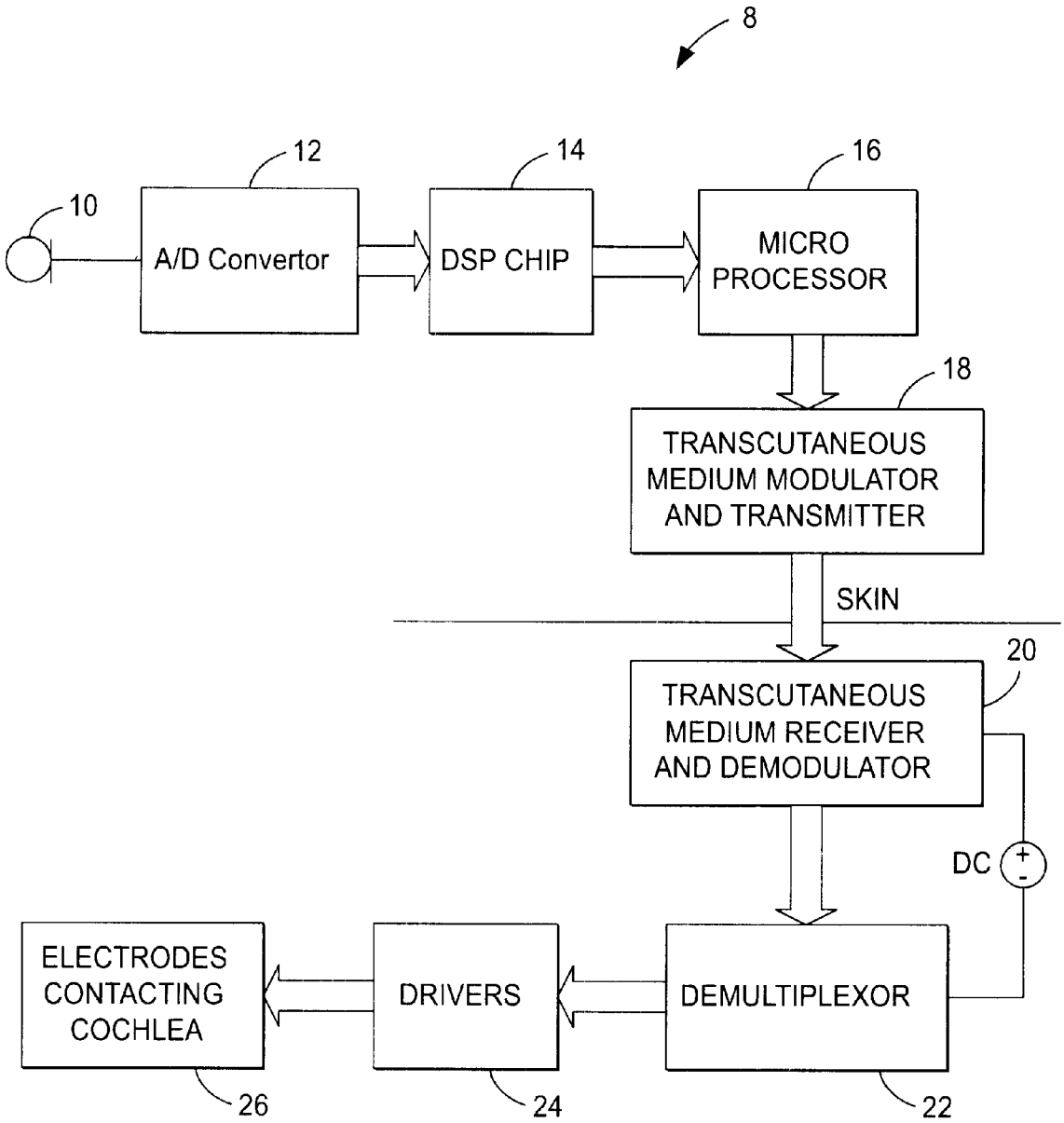
FIG. 1 is a block diagram of an assemblage of hardware that may serve as a host for the present invention.

FIG. 1 represents the set of physical elements that perform the signal processing that is the subject matter of the present invention, and is presented to help the reader understand the context of the present invention. A microphone 10 creates an analogue signal that the A/D convertor 12 changes to a digital stream. This digital stream is sent to a digital signal processing (DSP) chip 14 and a microprocessor 16, which together determine the amplitude and timing for each electrode to stimulate the cochlea and formats and outputs this information in a predetermined serial format. The DSP chip may incorporate the functions of the microprocessor in its computational load. For implementation of a cochlear implant processor, a modulator 18 places the information into a transcutaneous medium, such as radio frequency (RF), and transmits it to transcutaneous demodulator 20. A demultiplexor 22 divides the serial stream of information yielded by demodulator 20 into a set of pulse magnitude and timing commands for the drivers 24, each of which produces the electrical pulses to drive a particular electrode 26.

Figure 2:
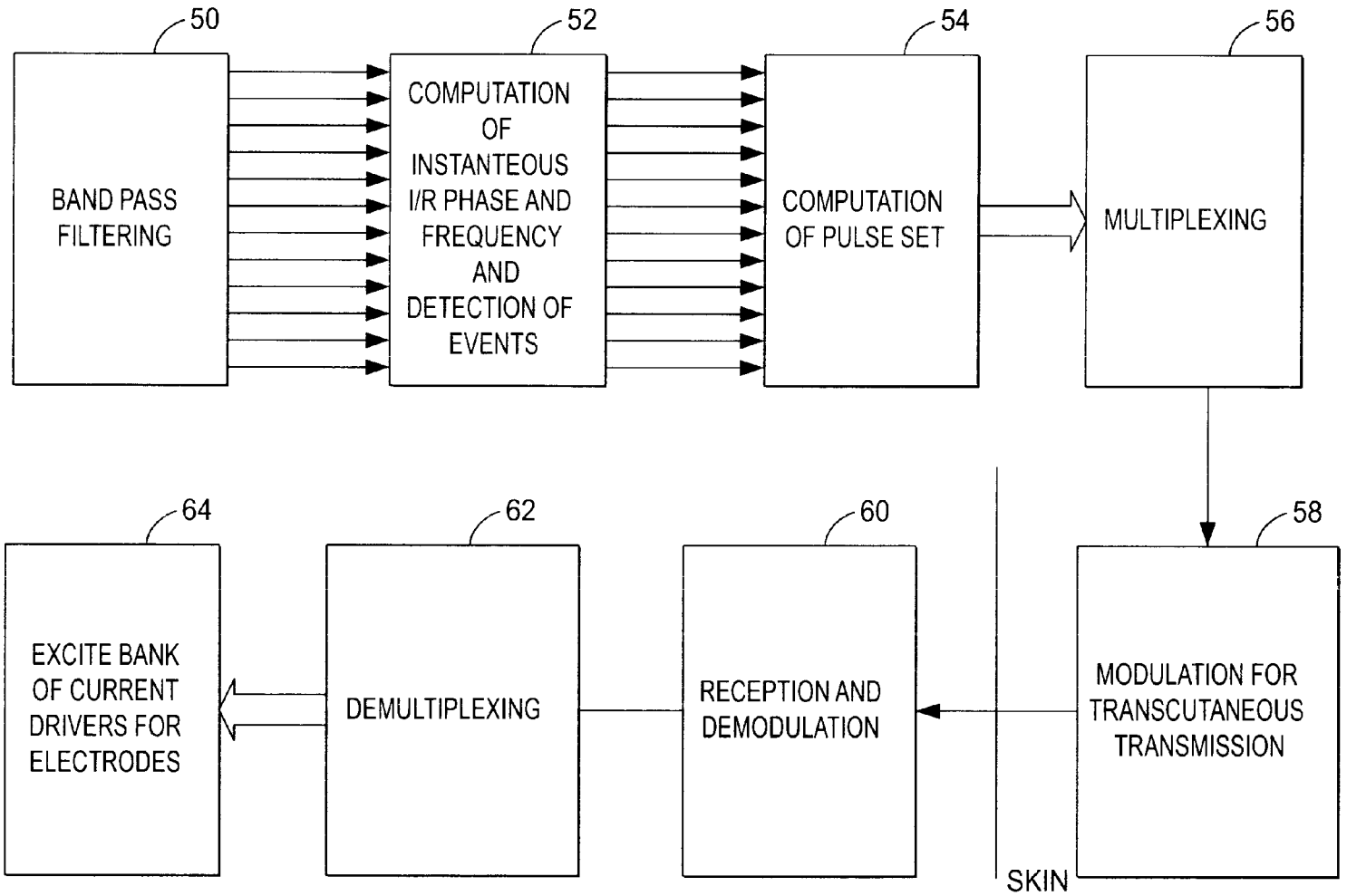
FIG. 2 is a block diagram of a flow of signal processing according to preferred embodiment of the present invention.
Figure 4:
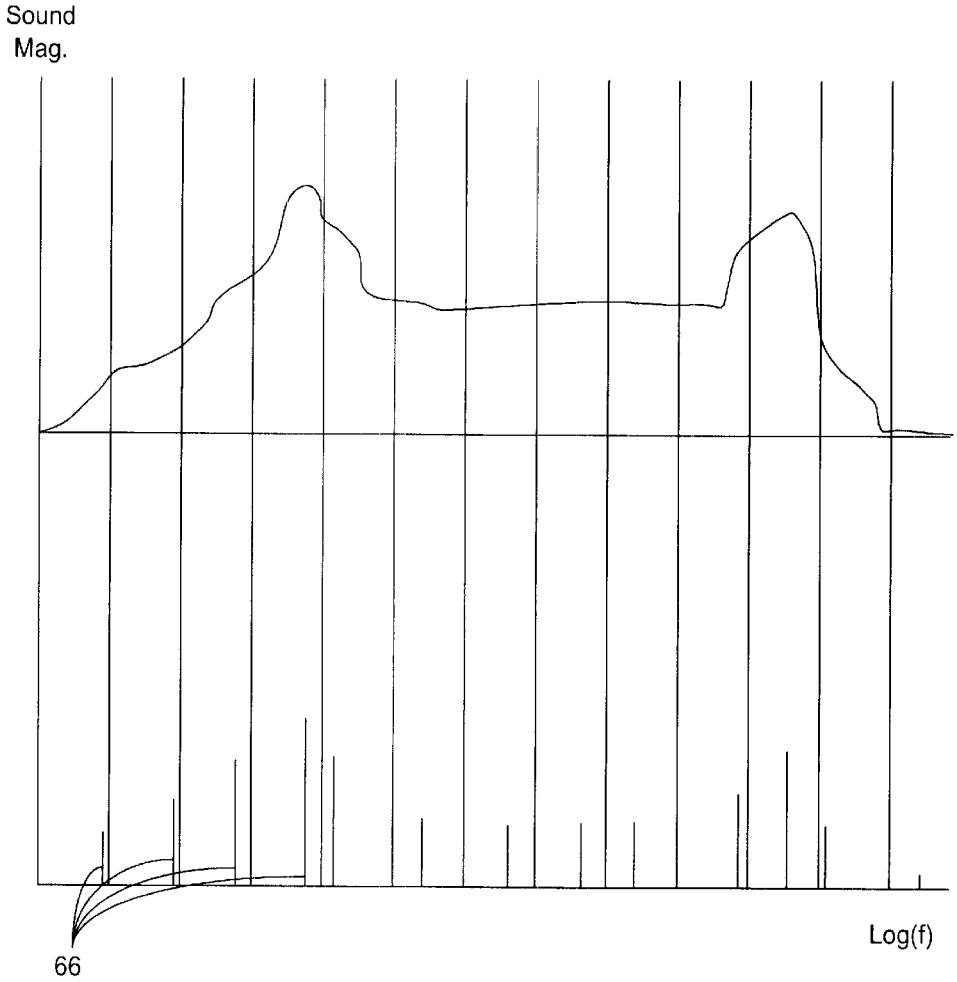
FIG. 4 is a pair of graphs in the signal amplitude versus frequency domain showing the spectrum of an auditory signal (top) and a set of events (bottom) consisting of an instantaneous frequency and amplitude pair that may be derived from the auditory signal.
Figure 5:
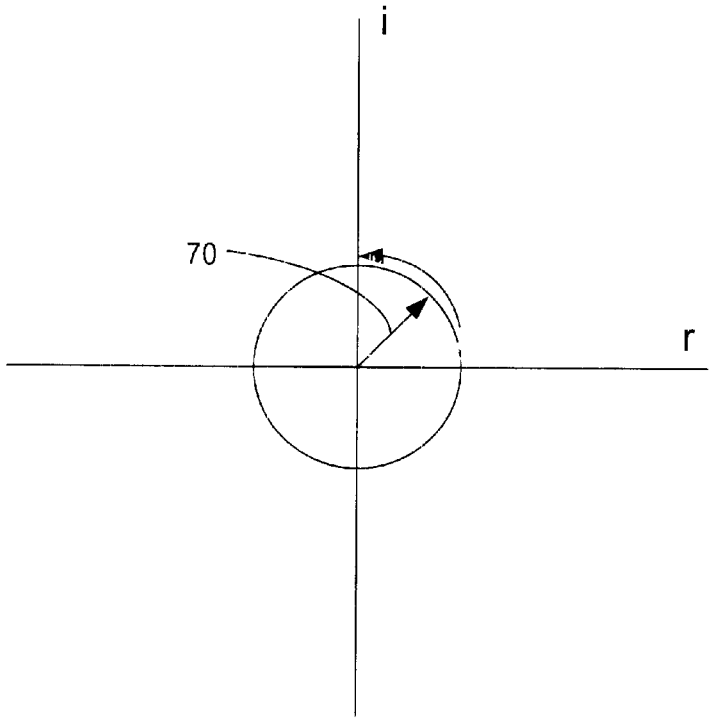
FIG. 5 is a graph in the real and imaginary coordinate system showing a vector comprised of the instantaneous phase and magnitude of a signal time sample from one bandpass filter.

Referring to FIG. 2 the digital signal processing in a preferred embodiment begins with the Hilbert transforming to produce an analytic signal and bandpass filtering (block 50) of this digitized analytic signal, into a set of frequency bands. This step is performed in the DSP chip 14. The dimensions of the resultant bands are indicated by the table of FIG. 3. Other sets of bands may also be desirable and would fall within the scope of the present invention. It may be desirable to tailor the bandwidth set to the individual patient. FIG. 4 (bottom) provides an indication of this division, with one vertical line lying within the frequency scope of each bandpass filter. As those skilled in the art of digital signal processing will readily recognize, the product of each bandpass filter is a time domain set of complex samples comprising an analytic signal, each having a real and imaginary component. Referring to FIG. 5, each real and imaginary filter time sample is mapped to a single complex vector whose successive time samples have magnitude and frequency properties. The vector magnitude (henceforth referred to as "instantaneous magnitude") and real/ imaginary phase (whose rate of change is "instantaneous frequency") are computed in the microprocessor 16. The phase difference between neighboring time samples is then computed to determine the instantaneous frequency of each band pass filtered signal (block 52 in FIG. 2). FIG. 4 shows a set of lines 66 having a height equal to the instantaneous magnitude and positioned at the instantaneous frequency points.

This information now permits considerable data compression for stimulation through a cochlear implant or for the transmission or storage of a compressed sound representation. A code could be constructed for including the instantaneous frequency/magnitude information for each frequency band to meet criteria specific to the end use. Perceptual criteria including masking and other known factors eliminate the need to transmit many samples. Furthermore, since lower frequencies are sampled more than needed to accurately represent them under the Nyquist criteria, updates at significantly longer intervals relative to the original digitized signal are possible. Furthermore, the elimination of signal events degrades the available information in a continuous fashion in contrast to the generation of large amounts of distortion as samples of the original signal are eliminated. Various compression schemes known to those familiar with signal processing would provide a means for optimally representing the information in a serial or parallel bit stream.

Figure 6:
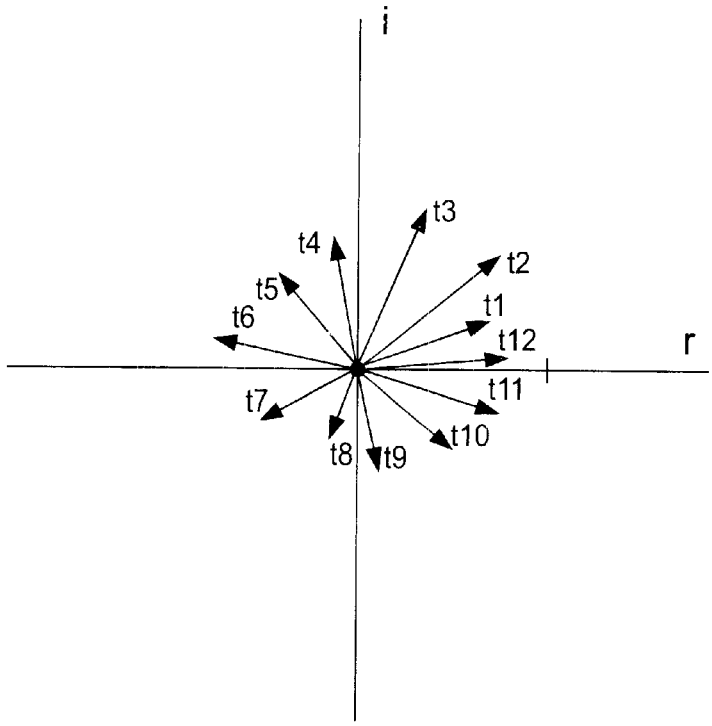
FIG. 6 is a graph in the real and imaginary coordinate system showing a time sequence of vectors, each comprised of the instantaneous phase and magnitude of a signal time sample.

FIG. 6 shows a sequence of real/imaginary vectors numbered according to each sample's relative time position in a sequence of samples. A similar sequence is constructed for each of the frequency bands shown in FIG. 4. The real axis crossing 60, where I=0, occurs between time samples 11 and 12. In one preferred embodiment, the cochlea is electrically stimulated at a time that is a uniform time delay from each such real axis crossing. The exact timing of the real axis crossing is determined through standard interpolation and is well within the limits of human discrimination for timing sound events in one ear or between the ears for low frequencies. Among advantages of event based cochlea stimulation is that for patients fitted with a cochlear implant in both ears (a binaural implant) the precisely timed binaural stimulation would give the patient a cue for the direction from which the sound was coming. Although, of course, the cochlear stimulation is delayed in both ears, it is the relative timing of stimulation that permits this determination to be made. Other events could be used for cochlear stimulation without diverging from the invention. Among events that could be used are imaginary axis crossings or combinations of axis crossings and criteria for successive instantaneous frequency occurrences.

At this point, the instantaneous frequency and magnitude at the moment of the event must, for each frequency band, be translated into a set of electrode stimulating pulses (block 54). The basic goal is to create a flow of electricity through the basilar membrane that will electrically stimulate the auditory nerve endings in a close proximity to the way they would be stimulated by a sound wave having the computed instantaneous magnitude and instantaneous frequency. It should be noted that the response of the cochlea to a sound wave at a single frequency is not limited to a single point on the cochlea. Rather, the traveling wave that is created has a significant effect over about 1 mm of cochlear length. To create a flow of electricity that stimulates the auditory nerve endings in a similarly restricted fashion, it is desirable to use a single electrode very near the target nerve endings or multiple electrodes to minimize the effective stimulating electrical field. For example, two electrodes, one being charged negatively and the other being charged positively, will concentrate current flow in the region between them By using three electrodes it is possible to concentrate the effective region of stimulation to an even greater extent.

Figure 7:
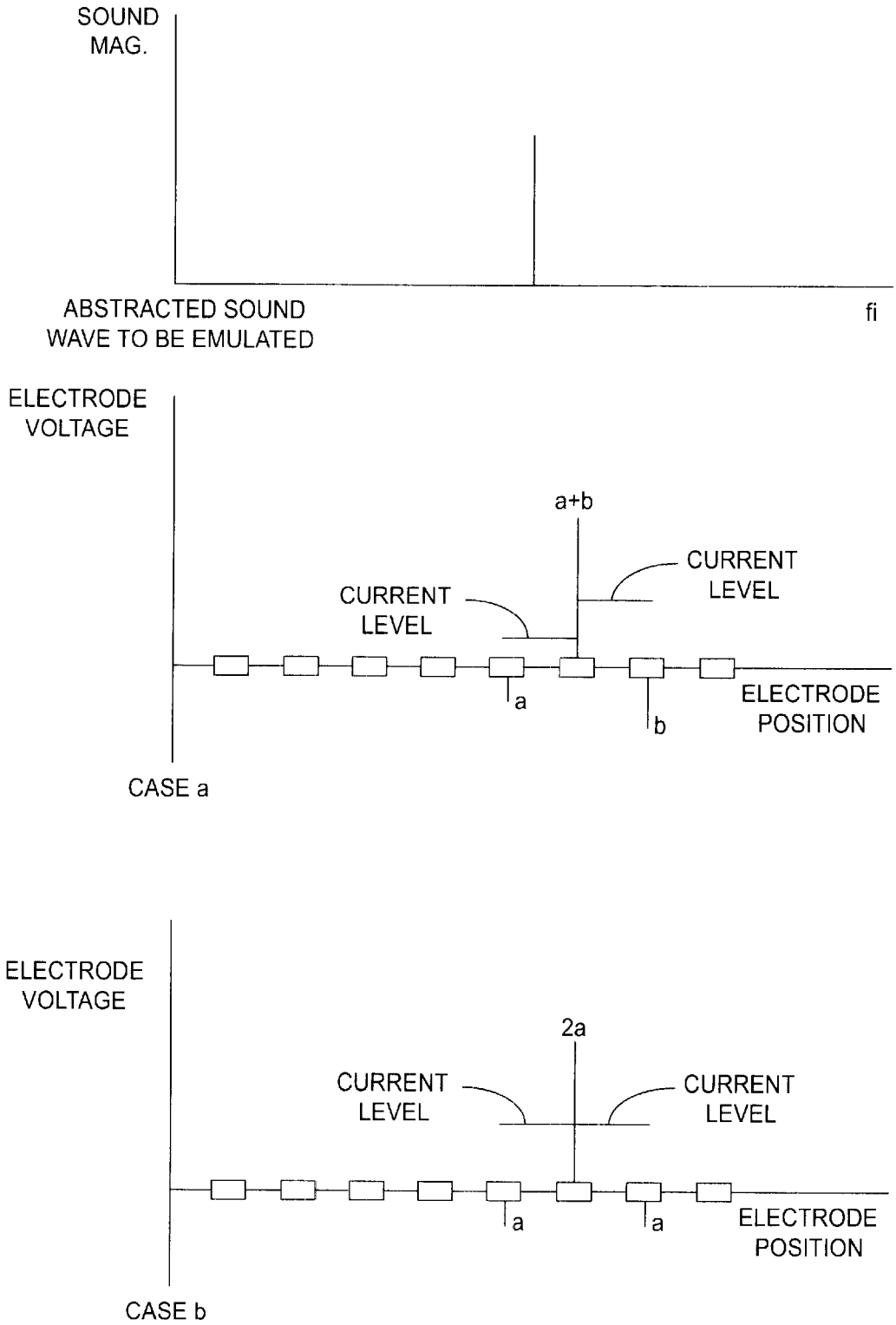
FIG. 7 is a pair of graphs, the top graph shows the instantaneous frequency and magnitude of a signal time sample and the bottom graph the electrical current applied to a set of cochlear implant electrodes to represent the instantaneous frequency and magnitude on the basilar membrane of the cochlea.

A feature of the present invention is the continuous mapping to cochlear loci of stimulus frequency. This enables the support of large numbers of electrode contacts located in high density along the basilar membrane. However, even large numbers of contacts (e.g., 40 to 100) may not actualize an exact mapping, so the calculation of pulse delivery, in addition to the restriction of current spread mentioned above, would include the selection of currents to maximally stimulate at a desired cochlear location even though it lies between adjacent electrodes. For example, if the instantaneous frequency translated to a location 15.2 mm from the beginning of the basilar membrane and electrodes were available at 14.5 and 15.3 mm, the following equation could be solved for relative current flow magnitudes:

$$(a*14.5+b*15.3)/(a+b)=15.2$$

where a and b are the relative currents at electrodes 1 and 2 relative to a distant reference. Current weighting of this nature can be extended to 3 or more contacts but is dependent on the homogeneity of the cochlear electroanatomy in the region of stimulation and on the distance from the stimulating electrodes to the excitable nerve cells. Adjustment of the currents can be used to accommodate inhomogeneities with perceptual feedback from the patient. FIG. 7 shows a single frequency and its magnitude. The frequency would be located at a position near to one of the electrodes drawn below it. The nearest electrode is to the left of the frequency line. That electrode is driven along with its two neighboring electrodes. In case a, the shaded electrodes are driven with the currents described by the equation on page 7. The central electrode carries a+b and the flanking electrodes carry -a and -b. To steer the current toward the right hand flanking electrode, b<a. The purpose is to attempt to steer electric current nearer to the nerves that encode that frequency. The technique works in some cases, but not in all. In case b, the shaded electrodes are driven in a quadruple configuration. The central electrode carries 2*a* and the flanking electrodes each carry -a.

In a cochlear implant 110 having two rows of transversely spaced electrodes 112 and 114 over the active length of the implant, the primary stimulus may be achieved by passing current between an electrode in row 112 and its corresponding electrode in row 114-. By restricting the spread of the current field this may achieve a stronger stimulation of the auditory nerves of interest.

This paragraph describes one method of stimulating the electrodes of the cochlear implant in conformity with the pulse magnitude and time values for each electrode that are determined as described above. There are many different possible ways of doing this, however, and the invention, specifically, is not in any way limited by or to the following described mechanism or assembly. Referring to FIGS. 1 and 2, the signals representing the pulse magnitude to be delivered to each electrode are multiplexed into a serial signal having a predetermined format (block 56) by the microprocessor 16. The signal is then modulated onto a medium, such as RF at encoder 18 (block 58) and transmitted into the body. In an alternative preferred embodiment the signal is sent by way of a percutaneous connector, eliminating the need for elements 18 and 20. A subcutaneous receiver and demodulator 60, receives and demodulates the signal from transmitter 18. The signal is then demultiplexed by a demultiplexor 24, into a set of channels equal to the number of electrodes 26 (block 62) and used to stimulate a set of electrode drivers 24 (block 54), which in turn stimulate the electrodes 26 that contact the cochlea.

As used in this patent application the term "set" may refer to a set containing a single element only.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for the real-time transformation of an electrical signal representative of a waveform, comprising:

(a) providing an electrical signal representative of sound;

(b) performing a signal transformation on said electrical signal to compute a time-varying complex signal, (c) passing said time-varying complex signal through a number of bandpass filters to create a parallel set of time domain band limited complex signals;

(d) computing a time stream of instantaneous frequency, phase angle and magnitude value sets for each of said parallel sets of time domain band limited complex signals; and (e) providing a cochlear stimulating device, including a set of electrodes that may be divided into subsets, wherein each subset is positioned on a different cochlear section and is assigned to a said time domain band limited complex signal corresponding in frequency band to said cochlear section;

(f) stimulating one or more said subsets with a time stream of electrical pulse sets, each said pulse set being formed so as to cooperatively create an electromagnetic field that is centered on the portion of the cochlea that most closely corresponds to said instantaneous frequency value, and that is substantially limited to a region defined by said subset of electrodes.

2. The method of claim 1 wherein said electrical signal representative of a waveform is in digital form.

3. The method of claim 1 wherein said bandpass filters include transfer function characteristics approximating the biomechanical properties of the outer, middle, and inner ear.

4. The method of claim 1 wherein said step of computing a time-varying complex waveform is performed by combining the original real waveform and its Hilbert transform, thereby obtaining an analytic signal.

5. The method of claim 1 wherein said computation of instantaneous phase angle and magnitude values for each set of said time domain real and imaginary band limited signals is performed at discrete intervals and produces a discrete stream of values.

6. The method of claim 1, further comprising detecting a stream of instantaneous phase angle transition events for each of said stream of instantaneous phase angle values.

7. The method of claim 6 wherein said instantaneous phase angle transition events are single phase angle transitions such as negative-to-positive imaginary portion transitions across the positive real axis.

8. The method of claim 6 wherein said electrical signal is further transformed by computing a stream of time domain pulses coinciding with each said stream of instantaneous phase angle transition events.

9. The method of claim 8 wherein said electrical signal is still further transformed by forming said streams of computed time domain pulses and sending each pulse stream to at least one electrode that is positioned on or near a portion of a human cochlea corresponding to the frequency band of said band limited signal from which said stream of pulses was formed.

10. The method of claim 1, further comprising detecting a stream of instantaneous phase angle transition events for each of said stream of instantaneous phase angle values.

11. The method of claim 1, further comprising synchronizing said pulse sets to said corresponding phase angle transition events.

12. The method of claim 11 wherein said pulse sets from each bandpass filter are selectively delayed to approximate normal basilar membrane delay functions corresponding to the traveling wave on the basilar membrane.

13. A method for the real-time transformation of a first electrical signal produced by a microphone located in or near one of the ears of a human and a second electrical signal produced by a microphone located in or near the other of the ears of said human, comprising:

(a) performing a signal transformation on said first and second electrical signals to compute first and second time-varying complex signals including real and imaginary components, (c) passing said first and second time-varying complex signals, in parallel, through a number of bandpass filters to create a first and second set of time domain band limited complex signals;

(d) computing a first and second set of instantaneous phase angle value streams and instantaneous magnitude value streams for said first and second sets of time domain band limited complex signals;

(e) detecting a first and second set of instantaneous phase angle transition event time streams for said first and second set of instantaneous phase angle value time streams;

(f) computing and forming a first and second set of time domain pulse time streams coinciding with said first and second set of instantaneous phase angle transition event streams; and (g) sending said first set of time domain pulse streams to a set of electrodes positioned on a first human cochlea, each electrode position corresponding to the frequency band of said band limited signal from which said time domain pulse stream was formed and sending said second set of time domain pulse streams to a set of electrodes positioned on a second human cochlea of the same human, each electrode position corresponding to the frequency band of said band limited signal from which said time domain pulse stream was formed, thereby effecting a binaural hearing restoration.

14. A method for stimulating a cochlea, comprising:

(a) providing an electrical signal representative of sound waveform;

(b) performing a signal transformation on said electrical signal to compute a time-varying complex signal including real and imaginary components, (c) passing said time-varying complex signal through a number of bandpass filters to create a parallel set of time domain band limited complex signals each in a substantially separate frequency band;

(d) computing an instantaneous phase angle and magnitude value time stream for each of said set of parallel time domain band limited complex signals;

(e) detecting an instantaneous phase angle transition event time stream for each said instantaneous phase angle value time stream;

(f) providing a cochlear implant bearing a set of electrodes and positioned within a cochlea so as to stimulate the cochlear nerve and wherein said set of electrodes may be divided into subsets, each subset corresponding to a cochlear section that corresponds to one of said substantially separate frequency bands and thereby to a said instantaneous phase angle transition event time stream; and (g) stimulating one or more cochlear sections with a time stream of electrical pulse sets matched in timing to said phase angle transition event time stream corresponding to said cochlear section.

15. The method of claim 14 wherein said instantaneous phase angle transition events are single phase angle transitions such as negative-to-positive imaginary portion transitions across the positive real axis.

* * * * *